US006928761B2

(12) United States Patent
Frappell

(10) Patent No.: US 6,928,761 B2
(45) Date of Patent: Aug. 16, 2005

(54) TAB WITH WRITING SURFACE

(75) Inventor: Richard Frappell, Eagle Farm (AU)

(73) Assignee: Carcraft QLD PTY LTD, Eagle Farm (AU)

( * ) Notice: Subject to any disclaimer, the term of this patent is extended or adjusted under 35 U.S.C. 154(b) by 0 days.

(21) Appl. No.: 10/380,479

(22) PCT Filed: Jun. 5, 2002

(86) PCT No.: PCT/AU02/00724

§ 371 (c)(1),
(2), (4) Date: Mar. 20, 2003

(87) PCT Pub. No.: WO02/098679

PCT Pub. Date: Dec. 12, 2002

(65) Prior Publication Data

US 2004/0083635 A1 May 6, 2004

(30) Foreign Application Priority Data

Jun. 5, 2001 (AU) ..... PR5476

(51) Int. Cl.[7] ..... G09F 23/10

(52) U.S. Cl. ..... 40/641; 40/647; 40/661; 40/661.06

(58) Field of Search ..... 40/641, 359, 642.02, 40/655, 658, 647, 648, 661, 661.06, 661.07, 661.11, 611.03

(56) References Cited

U.S. PATENT DOCUMENTS

| | | | | | |
|---|---|---|---|---|---|
| 1,573,264 | A | * | 2/1926 | Mankameyer | 40/611.03 |
| 3,664,051 | A | | 5/1972 | Benichou | |
| 4,053,057 | A | | 10/1977 | Snowden | |
| 4,079,533 | A | | 3/1978 | Rohner | |
| 4,209,925 | A | | 7/1980 | Briigmann | |
| 4,232,461 | A | * | 11/1980 | Crawford | 40/641 |
| 4,255,888 | A | | 3/1981 | Bastogne | |
| 4,318,236 | A | * | 3/1982 | Giulini | 40/360 |
| 5,311,685 | A | | 5/1994 | Wyant | |
| 6,332,285 | B1 | * | 12/2001 | Aaldenberg et al. | 40/641 |

FOREIGN PATENT DOCUMENTS

| | | |
|---|---|---|
| AU | 59101 | 11/1971 |
| AU | 61432 | 5/1973 |
| AU | 75419 | 12/1978 |
| AU | 103519 | 5/1988 |
| AU | 123121 | 3/1995 |
| DE | 3301805 | 7/1984 |
| DE | 20001525 | 6/2000 |
| FR | 1578894 | 8/1969 |
| FR | 2288004 | 10/1974 |
| FR | 2716739 | 9/1995 |
| GB | 1379733 | 1/1972 |
| GB | 1425504 | 2/1976 |
| GB | 1438937 | 6/1976 |
| WO | WO93/25394 | 12/1993 |

OTHER PUBLICATIONS

DS1536–709, Apr. 28, 1967, Fa Leitz Louis.

* cited by examiner

*Primary Examiner*—Gary C. Hoge
(74) *Attorney, Agent, or Firm*—Hoffman, Wasson & Gitler, P.C.

(57) ABSTRACT

An identification tab which is particularly suitable for use with a suspension folder. The tab has a rigid flat writing surface, which is overlaid by a transparent window in a first configuration and which is exposed for writing on a second configuration. The writing surface and the window are connected together so as to not, in either the first or second configuration, be separated from one another but to be separable if need b without destroying their integrity.

8 Claims, 6 Drawing Sheets

TAB WITH WRITING SURFACE

BACKGROUND OF THE INVENTION

This invention relates to tabs and is particularly concerned with tabs which can be written on for the purpose of identifying or labelling personal or commercial items, contents of files and product packaging or transportation, and so forth. The invention has primarily been devised for use in connection with suspension files for stationery and will mostly be described in that context however that use is not to be construed as in any way being limitative on the scope of the invention and the broader usages are to be borne in mind.

DESCRIPTION OF THE PRIOR ART

A large number of different types of identification tabs used in connection with suspension files mostly comprise a clear plastic clip-on envelope or sleeve in which a label comprising a strip of cardboard of stiff paper can be inserted with the required identifying information. The identifying information is typically hand-written on the label prior to insertion in the tab. Examples of such identification tabs are described in U.S. Pat. Nos. 3,664,051; 4,209,925; 5,311,685; and 4,053,057; British Patent Nos. 1,425,504 and 1,438,937; French Patent No. 2716738; and Australian Design Nos. 103519 and 123121.

In practice, the contents of the file often changes, necessitating new identifying information. This normally means that the old label must be discarded and a new label found. More often that not, there is no new label at hand and one must be made by cutting out a piece of paper to the required size and then trying to insert it in the tab. The paper, not being as rigid as the typical standard label, often crumples, may not be cut straight, and can end up looking a mess. Apart from this, significant time and effort is involved in obtaining the new label.

OBJECTS OF THE INVENTION

It is a main object of the invention to provide an identification tab which has a re-usable writing surface.

Another object of the invention is to provide an envelope or sleeve which can accommodate a re-usable writing surface or which has a re-usable writing surface incorporated therein.

A still further object of the invention is to provide an identification tab for suspension folders and the like, which tab has a re-usable writing surface in association therewith.

Each of the aforementioned objectives are deemed to be mutually exclusive of one another, that is to be individually limited to only one aspect of what is deemed to be the all embracing inventive concept, which the skilled addressee will appreciate from the succeeding description.

SUMMARY OF THE INVENTION

According to the present invention there is provided an identification tab having a rigid, non-transparent writing surface which is overlaid by a transparent window in a first tab configuration and which is exposed for writing on in a second tab configuration, wherein the writing surface and the window are connected together so as to not, in either the first or second tab configuration, be separated from one another but to be separable if need be without destroying their integrity.

DETAILED DESCRIPTION OF THE INVENTION

The writing surface of the identification tab should preferably be such as to provide a dry erasable system although other types of erasable systems may also be equally well used. The dry erasable system enables marking with writing instruments such as felt tip instruments which contain specifically formulated inks to enable erasure after the ink has dried.

Suitable writing surfaces which have the appropriate degree of rigidity can be formed from plastics and coated paperboard stock, and various laminated structures thereof, which can be surface treated with an appropriate lacquer, paint or polymeric material to provide the necessary surface features for a dry erasable system. The writing surface will be preformed into the required shape such as a short narrow strip for use in a suspension tab.

The particular writing surface chosen will be such as to enable indicia which is applied thereto by a writing implement, to be removed by wiping across the surface with a finger, cloth, tissue or the like. -That is removal of the indicia will be effective and effortless to leave a clean surface on which new indicia can be written. Preferably, the writing surface is formed from a plastics material such as injection moulded polypropylene which has a smooth rectangular configuration.

The transparent window provides a protective cover for the writing surface to ensure that the indicia written thereon cannot be erased whilst the writing surface remains covered by the transparent window. Suitably, the transparent window is formed from a plastics material, such as polyacrylate.

Preferably, the writing surface and the window are pivotally joined to one another. In the case where the writing surface has a rectangular configuration, the window can be pivotally joined to the writing surface at opposing short sides thereof adjacent one longitudinal edge.

A lug can be provided on the window to aid in pivoting the window between the first tab configuration and the second tab configuration. The lug can be located in the central edge or the outer edges of the window. Preferably, there is a lug located on each outer short edge of the window.

The means enabling connection of the tab to a folder can comprise a protruding clip which clips to a runner formed along an upper edge of the suspension folder.

Preferably, the clip comprises a central portion with an offset portion on each side which together form a rectangular channel which fits over the runner; there being detents on bottom sections of the central and offset portions for retaining the tab on the runner.

Non-limiting identification tab constructions include those in which:

(1) the window pivots open to enable access to the writing surface, wherein the writing surface can be formed integrally with an envelope or sleeve, or can be a separate component thereto;

(2) the window slides open to reveal a writing surface formed integrally with an envelope or sleeve;

(3) the writing surface is slidable relative to the window so that it can be slid behind the window and retracted for writing upon or erasure of the writing; and (4) the writing surface is pivotable relative to the window so that it can be pivoted about a point near one end to expose the writing surface for writing or erasure purposes when required.

DESCRIPTION OF PREFERRED EMBODIMENTS

Figure 1:
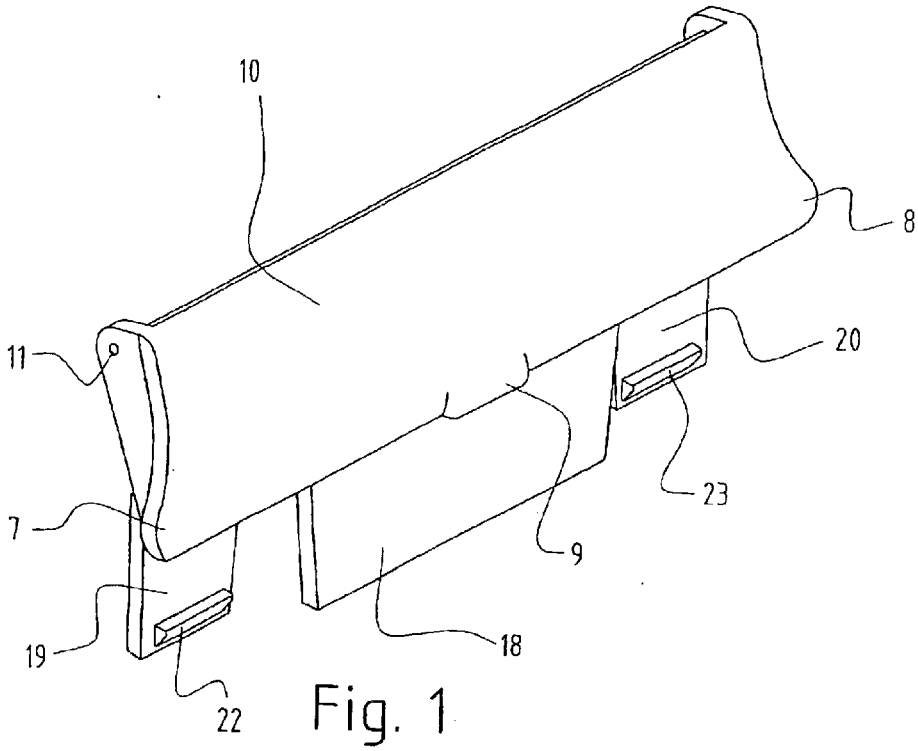
FIG. 1 is a perspective view of a closed identification tab with a pivoting window in a first configuration according to one aspect of the invention.
Figure 2:
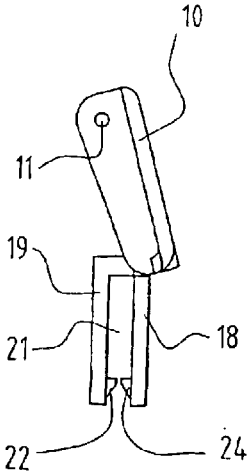
FIG. 2 is a front plan view of the identification tab shown in FIG. 1.
Figure 3:
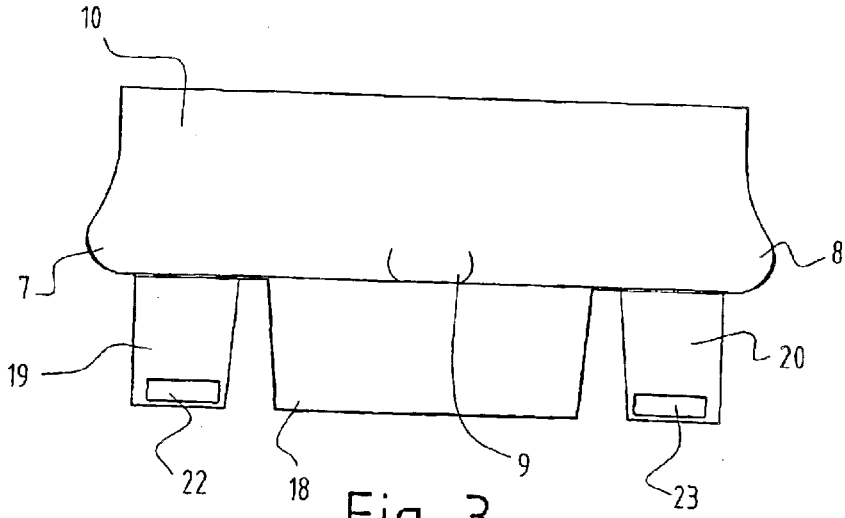
FIG. 3 is an end-on view of the identification tab shown in FIG. 1.

Preferred embodiments of the invention will now be described with reference to the aforementioned drawings in all of which like reference numerals refer to like parts.

Reference is made firstly to the identification tab illustrated in FIGS. 1–6. The tab consists of a transparent perspex window 10 which is hingedly connected to a writing surface 12 at pivots 11, 13. Pivots 11, 13 comprise nodes formed on the edges of the writing surface which project into recesses formed in end walls 14, 15 of the window 10. The hinged connection is such that the window 10 can be separated from the writing surface 12, if need be, without destroying the integrity of the connection system.

The window 10 is normally held against the writing surface 12 by means of the pivots as well as retainers 16, 17 extending from the inside faces of end walls 14, 15 of the window, which catch on the rear face of the writing surface 12.

Lugs 7, 8 project from each end of the window and a further lug 9 projects from the mid region. The lugs assist in pivoting the window 10 from the first configuration shown in FIG. 1 to the second configuration shown in FIG. 2. That is, the lugs provide a purchase point for a finger to exert sufficient pressure on the window to pivot it over the retainers 16, 17 when opening the window to expose the writing surface.

The writing surface 12 is substantially rectangular in shape and is formed from white polypropylene so as to provide a smooth surface to which indicia can be applied, for instance by the use of a nonpermanent felt pen. The writing surface 12 has an integrally formed clip means to enable attachment to a suspension folder. The clip means consists of a central protruding portion 18 and two offset portions. 19, 20 extending from opposing sides of the writing surface, so as to, in combination, provide a rectangular channel 21 which fits over a runner of the suspension folder. The tab is prevented from slipping off the suspension folder by means of teeth 22, 23, 24 on the lower ends of the central and offset clip portions which extend under the lower edge of the suspension folder runner.

Figure 4:
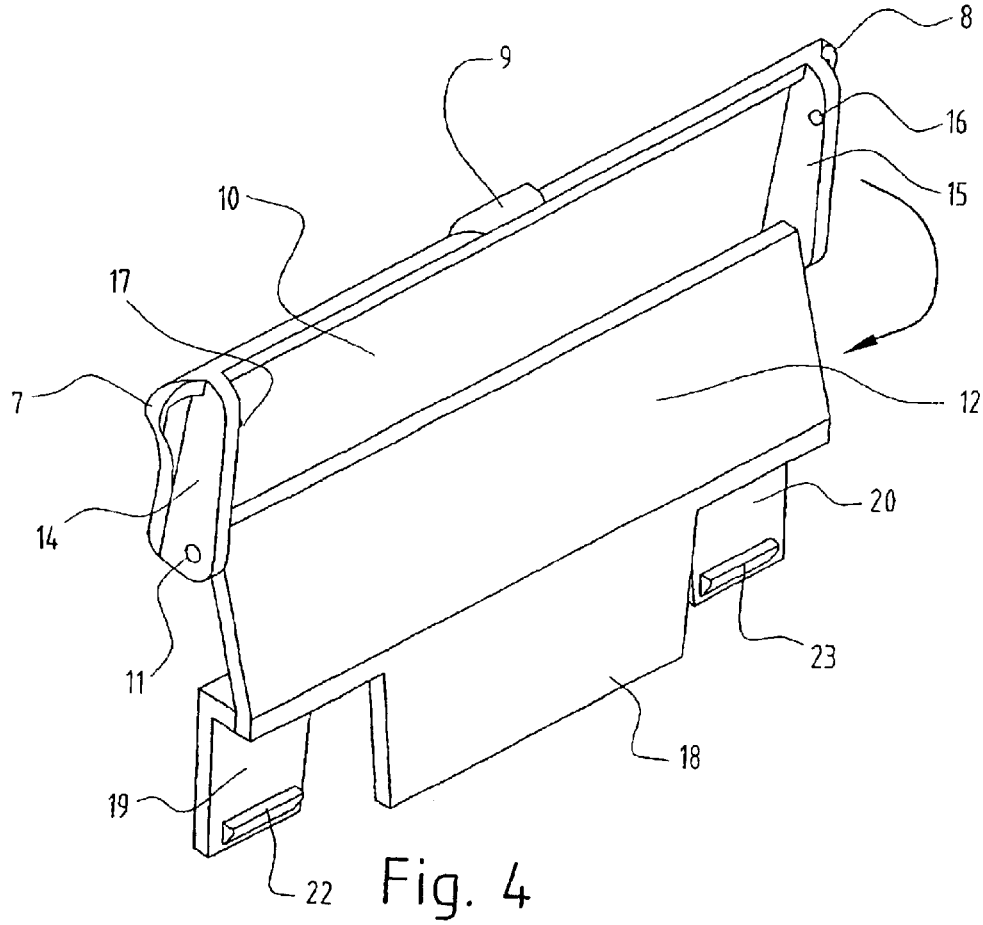
FIG. 4 is a perspective view of the identification tab shown in FIG. 1 in an open or second configuration.
Figure 5:
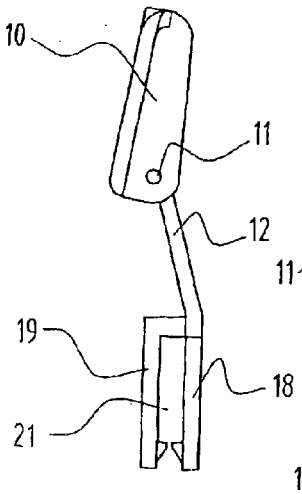
FIG. 5 is an end-on view of the tab of FIG. 4.
Figure 6:
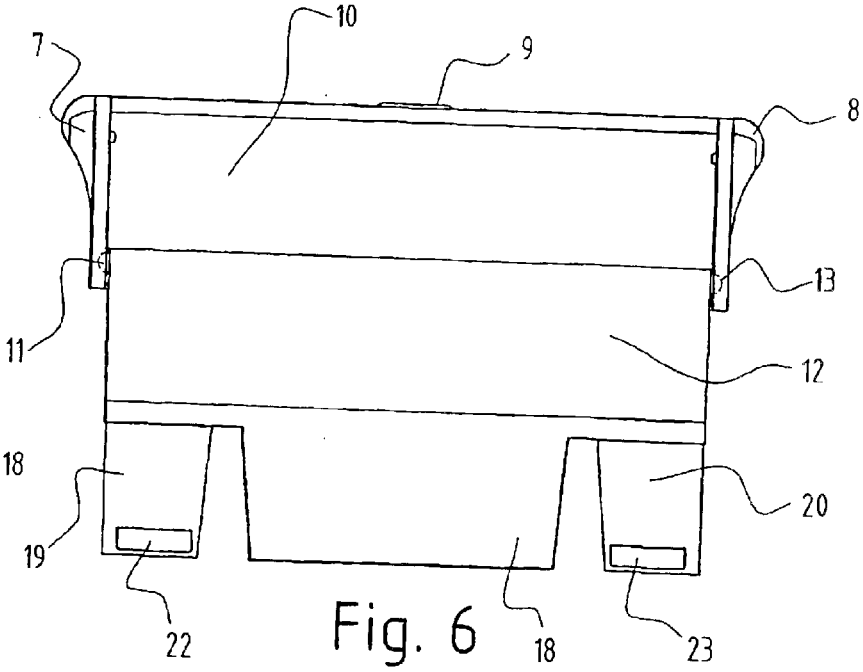
FIG. 6 is a front plan view of the tab of FIG. 4.

The writing surface is such that when exposed by pivoting the window to the second tab configuration shown in FIG. 4, indicia can be applied thereto and subsequently removed by wiping across the surface with a finger, cloth or tissue.

Figure 9:
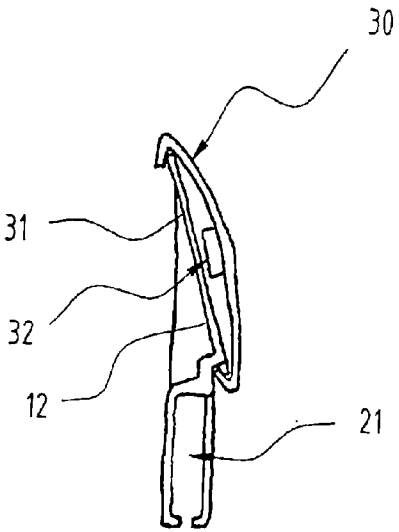
FIG. 9 is an end view of the tab of FIG. 7.
Figure 7:
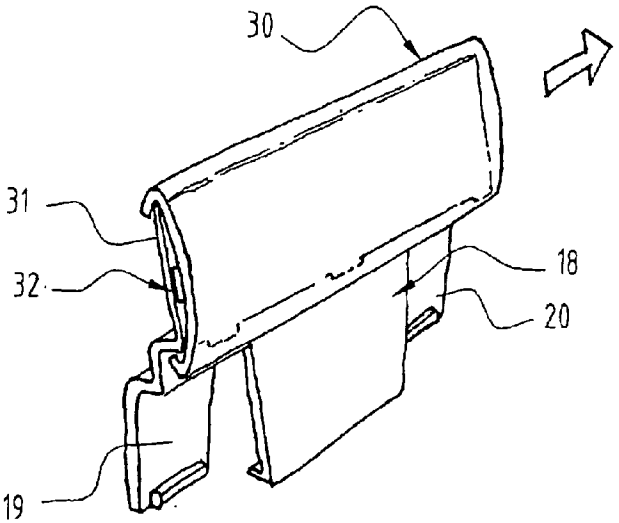
FIG. 7 is a perspective view of an identification tab with a sliding window in a first configuration according to another aspect of the invention.
Figure 8:
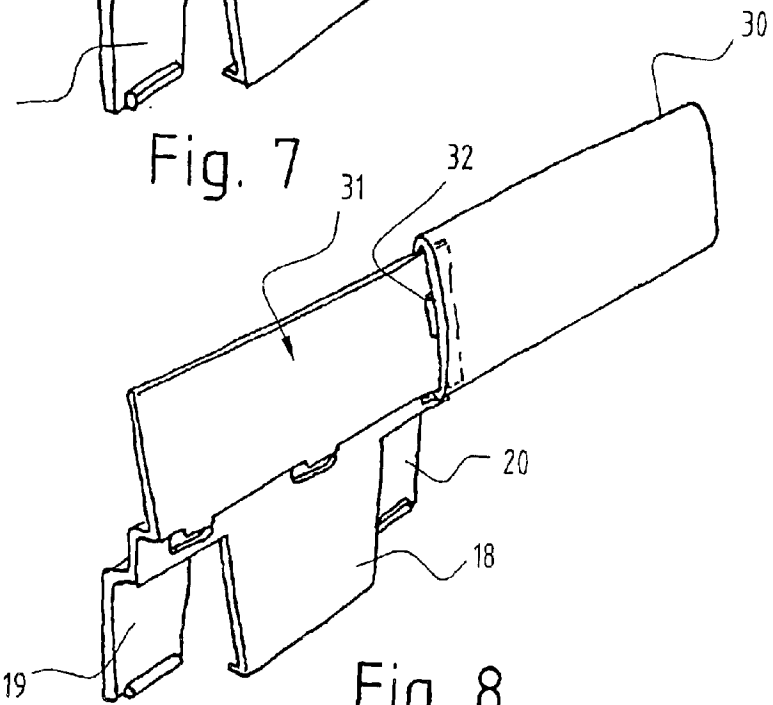
FIG. 8 is a perspective view of the tab shown in FIG. 7 in a second configuration.
Figure 10:
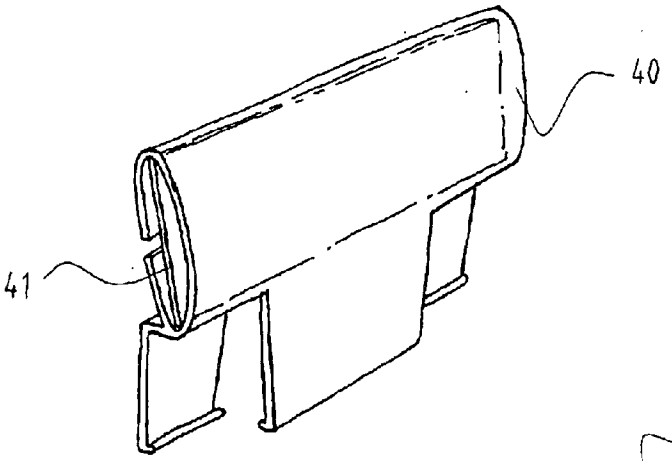
FIG. 10 is a perspective view of an identification tab with a sliding writing surface in a first configuration according to another aspect of the invention.
Figure 11:
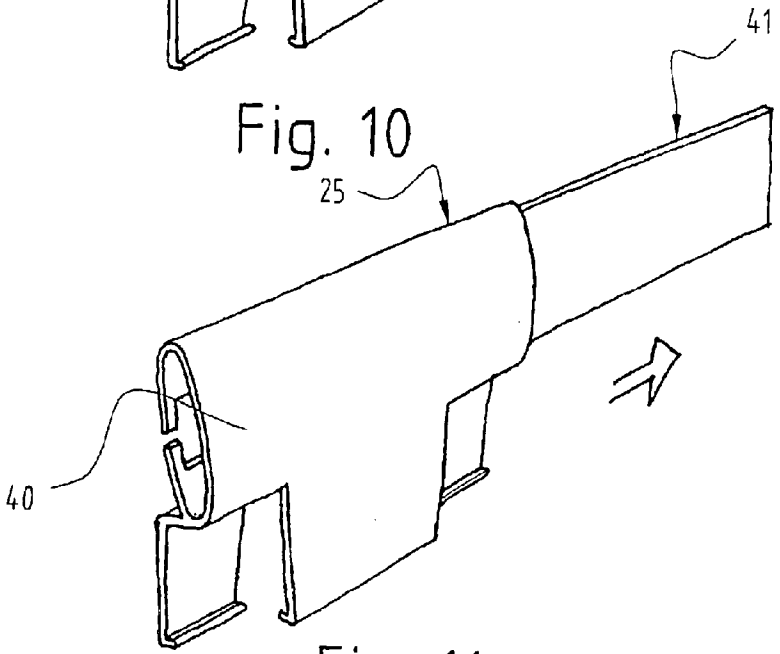
FIG. 11 is a perspective view of the tab shown in FIG. 10 in a second configuration.
Figure 12:
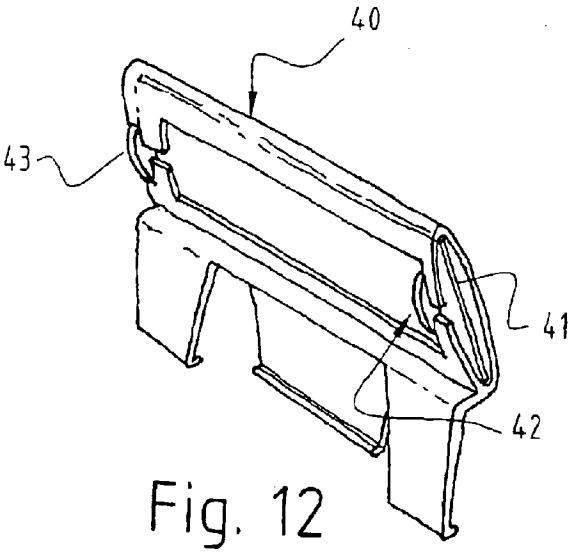
FIG. 12 is a rear view of the tab shown in FIG. 10.
Figure 13:
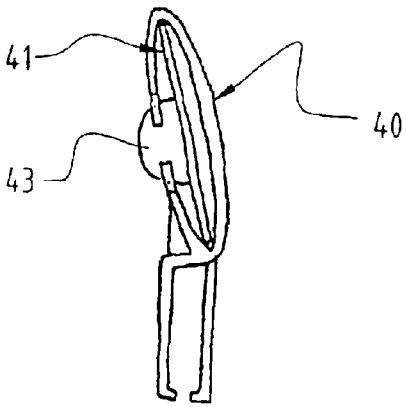
FIG. 13 is an end-on view of the tab shown in FIG. 10.
Figure 14:
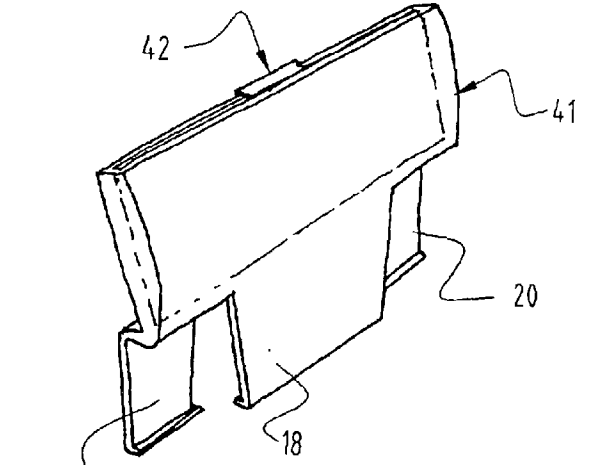
FIG. 14 is a perspective view of an identification tab with a sliding writing surface in a first configuration according to another aspect of the invention.
Figure 15:
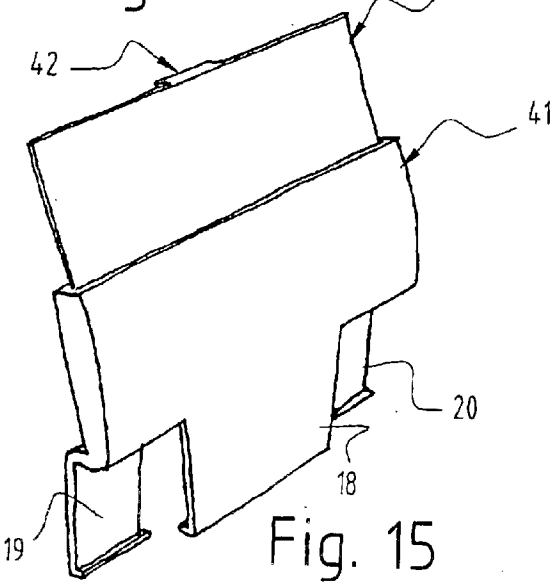
FIG. 15 is a perspective view of the tab shown in FIG. 14 in a second configuration.
Figure 16:
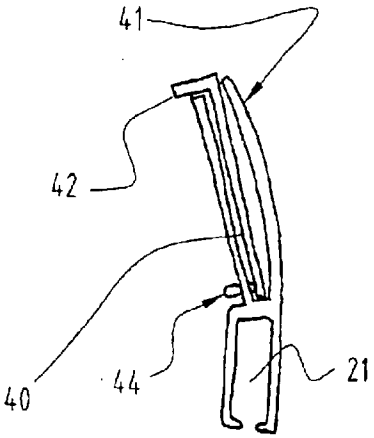
FIG. 16 is an end-on view of the tab shown in FIG. 14.
Figure 17:
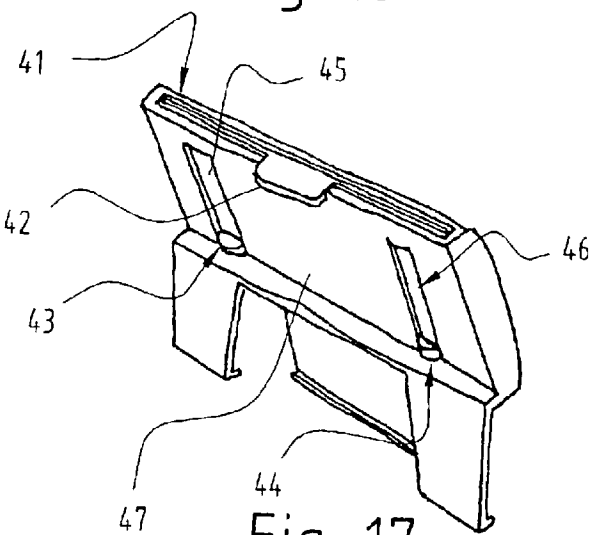
FIG. 17 is a perspective view of the tab shown in FIG. 14.

In FIGS. 7–9, the identification tab has a slidable transparent window 30 which wraps over the writing surface 31. The writing surface has an integrally formed suspension file connection means as described with reference to the preceding embodiment and is formed from white injection moulded polypropylene. The transparent window 30 is held on the writing surface 12 by virtue of the longitudinal edges of the transparent window folding over the longitudinal edges of the writing surface as illustrated. Extensions, for example 32, integrally formed on the rear surface of the window 30 limit the window from being removed from the tab.

With reference to FIGS. 10–13, the identification tab comprises a fixed transparent window 40 formed as an integral part of the suspension file connection means. The writing surface 41 is reciprocally movable within the transparent window 40 in a horizontal direction behind the window. Projection 42 on the writing surface 41 delimits the movement of the writing surface so that it cannot be completely withdrawn from the tab. Lug 43 on the writing surface provides a purchase position to enable the writing surface to be slid out from the tab to the second configuration shown in FIG. 11.

FIGS. 14–17 show a variation of the tab shown in FIGS. 10–13 in that instead of the writing surface 40 being horizontally movable, in this case it is vertically slidable behind window 41. A lug 42 formed on the top edge of the writing surface 40 enables the writing surface to be raised by hand and protrusions 43, 44 on the bottom rear faced the writing surface delimit the removal of the writing surface from behind the window by having restricted movement in slots 45, 46 formed in the rear surface 47 of the tab but still enabling separation of the writing surface from the tab without destroying the integrity of the arrangement.

Figure 18:
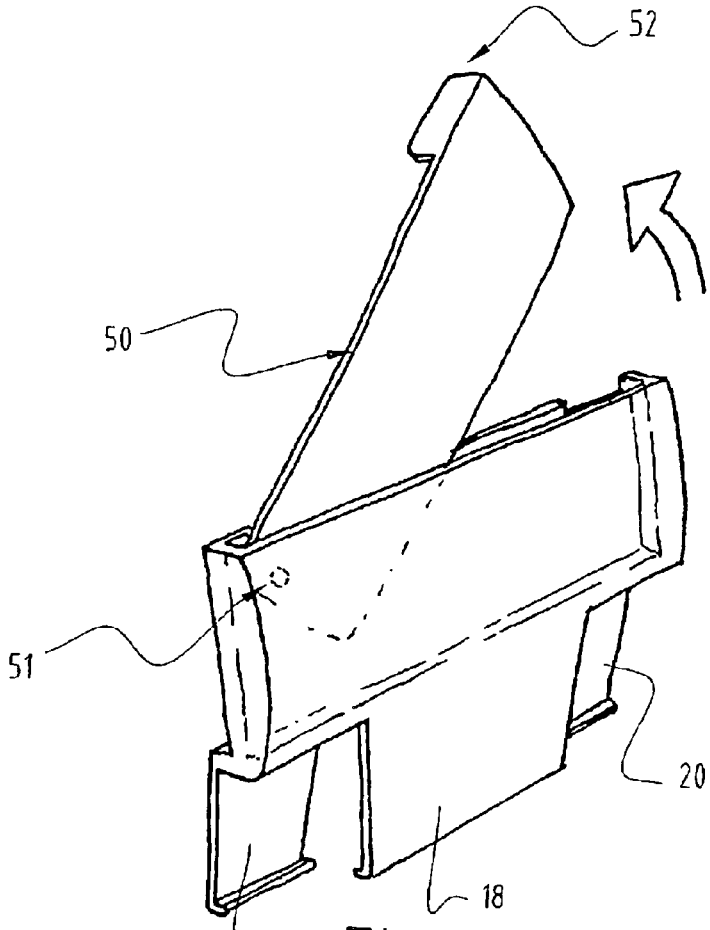
FIG. 18 is a perspective view of an identification tab with a pivoting writing surface in first configuration according to another aspect of the invention.
Figure 19:
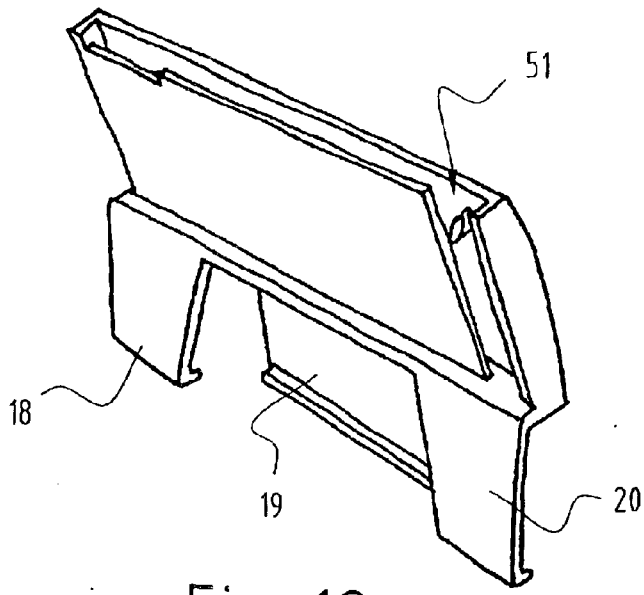
FIG. 19 is a rear view of the tab shown in FIG. 18 with the writing surface removed.

In FIGS. 18 and 19, the identification tab has a pivoting writing surface 50. The writing surface 50 is hinged at 51 and can be accessed by raising a finger lug 52 to rotate the writing surface in the direction shown by the arrow.

The identification tabs according to the present invention are primarily designed to be written on by conventional white-board-type marker pens and are such that the writing can be erased by a simple wipe of the finger, tissue or cloth, or the like over the surface. This provides a very easy and convenient way of updating or re-labelling an article or folder without the previous burden of having to prepare a new label.

The identification tabs provide an efficient and cost-effective means of labelling and relabelling articles, and are particularly suitable for use with suspension folders, however they are by no means limited to such use, the broader aspects of which are embodied in the following claims.

What is claimed is:

1. An identification tab for a suspension file, said tab having a rigid, nontransparent writing surface which is overlaid by a transparent window in a first tab configuration and which is exposed for writing on in a second tab configuration, wherein the writing surface is substantially rectangular in configuration and the window is pivotally joined to the writing surface at opposing short sides thereof adjacent the longitudinal edge and including means enabling connection of the tab to the suspension folder and wherein the rigid, non-transparent writing surface is adapted to be marked with a dry erasable system.

2. An identification tab as claimed in claim 1, wherein the writing surface is constructed so as to enable indicia which is applied thereto by a writing implement, to be removed by wiping across the surface with a finger, cloth, or tissue.

3. An identification tab as claimed in claim 1, wherein the writing surface is a substantially smooth plastics material.

4. An identification tab as claimed in claim 1, wherein the writing surface is injection molded polypropylene.

5. An identification tab as claimed in claim 1, wherein the window is injection molded polyacrylate.

6. An identification tab as claimed in claim 1, wherein the window has a lug extending therefrom to aid in pivoting the window between the first tab configuration and the second tab configuration.

7. An identification tab as claimed in claim 1, wherein the means enabling connection of the tab to a folder comprises a protruding clip which clips to a runner formed along an upper edge of the folder.

8. An identification tab for a suspension file, said tab having a rigid, nontransparent writing surface which is overlaid by a transparent window in a first tab configuration and which is exposed for writing on in a second tab configuration, wherein the writing surface is substantially rectangular in configuration and the window is pivotally joined to the writing surface at opposing short sides thereof adjacent the longitudinal edge and including means enabling connection of the tab to the suspension folder and wherein the opposing short sides of the window include retainers which project therefrom so as to catch on the rear face of the writing surface when in the first configuration, thereby, along with the pivotal joints, acting to retain the window against the writing surface.

* * * * *